US007841881B2

(12) United States Patent
Hsu et al.

(10) Patent No.: US 7,841,881 B2
(45) Date of Patent: Nov. 30, 2010

(54) WATERPROOF CABLE CONNECTOR

(75) Inventors: Ching-Min Hsu, Tamshui Chen (TW); Che-Lun Lee, Tamshui Chen (TW); Tsung-Ming Chen, Tamshui Chen (TW)

(73) Assignee: Acbel Polytech Inc. (TW)

( * ) Notice: Subject to any disclaimer, the term of this patent is extended or adjusted under 35 U.S.C. 154(b) by 38 days.

(21) Appl. No.: 12/321,990

(22) Filed: Jan. 28, 2009

(65) Prior Publication Data

US 2010/0029114 A1 Feb. 4, 2010

(30) Foreign Application Priority Data

Jul. 31, 2008 (TW) ..... 97128973 A

(51) Int. Cl.
*H01R 13/52* (2006.01)

(52) U.S. Cl. ..... 439/277

(58) Field of Classification Search ..... 439/277–284, 439/367; 174/93–94

See application file for complete search history.

(56) References Cited

U.S. PATENT DOCUMENTS 2,688,651 A * 9/1954 Blake ..... 174/93
2,938,940 A * 5/1960 Calendine et al. ..... 174/76
3,270,312 A * 8/1966 Olsen ..... 439/367
4,571,018 A * 2/1986 Annoot ..... 439/281
4,733,937 A * 3/1988 Lia et al. ..... 385/117
4,773,729 A * 9/1988 Mignien ..... 385/135
5,299,951 A * 4/1994 Blaetz ..... 439/367
6,584,253 B2 * 6/2003 Kordahi et al. ..... 385/100
6,916,203 B2 * 7/2005 Oyamada et al. ..... 439/587
6,918,787 B2 * 7/2005 Egan ..... 439/587
7,303,418 B2 * 12/2007 O'Connor ..... 439/277
2004/0231881 A1 * 11/2004 Muller et al. ..... 174/93

* cited by examiner

*Primary Examiner*—Renee S Luebke
*Assistant Examiner*—Larisa Tsukerman
(74) *Attorney, Agent, or Firm*—Jackson Walker, LLP

(57) ABSTRACT

A waterproof cable connector has a body, two plugs and at least one sealing ring. The body has a chamber and two through holes communicating with the chamber. The plugs are respectively connected to the body via the through holes and each plug has a clamping ring and a securing fastener. The clamping ring is mounted in the body and has multiple grooves and multiple tabs. The securing fastener is mounted around the clamping ring to press the tabs of the clamping ring. The at least one sealing ring is elastic and waterproof and is mounted between separate parts on the body to prevent water from permeating the chamber of the body.

14 Claims, 7 Drawing Sheets

WATERPROOF CABLE CONNECTOR

BACKGROUND OF THE INVENTION

1. Field of the Invention

The present invention relates to a cable connector and more particularly to a waterproof cable connector having reduced size and being assembled quickly to prevent water from permeating a chamber thereof.

2. Description of Related Art

Cables are used to transport electricity or signals for electric devices such as telephones, facsimiles, computers or the like and connectors are frequently implemented to join two wires directly.

With reference to FIGS. 6 and 7, a conventional waterproof cable connector comprises two wires (80), a casing (50), a cover (60) and a seal (70).

The casing (50) has two opposite sides, a top, four corners, a chamber, two through holes (51), two plugs (52), an opening (53) and four threaded holes (54). The through holes (51) are respectively formed through the opposite sides of the casing (50) to let the wires (80) extending through the casing (50) and communicate with the chamber. The plugs (52) are respectively mounted in the through holes (51) of the casing (50). The opening (53) is formed through the top of the casing (50) and communicates with the chamber. The threaded holes (54) are respectively formed in the corners of the casing (50) at the top.

The cover (60) is mounted on the top of the casing (50) to cover the opening (53) and has four corners and four connecting holes (61). The connecting holes (61) are respectively formed through the corners of the cover (60) and respectively align with the threaded holes (54) of the casing (50).

The seal (70) is mounted between the cover (60) and the top of the casing (50) to prevent water penetrating the casing (50).

However, when assembling the conventional waterproof cable connector with wires (80), a user needs to mount the seal (70) and the cover (60) on the top of the casing (50) and fasten multiple screw bolts (71) with the threaded holes (54) of the casing (50) to hold the cover (60) and the seal (70) with the casing (50), and this is time-consuming. In addition, the casing (50) of the conventional waterproof cable connector is substantially larger then the wires or the connectors, so is inconvenient to use.

To overcome the shortcomings, the present invention tends to provide a waterproof cable connector to mitigate the aforementioned problems.

SUMMARY OF THE INVENTION

The main objective of the present invention is to provide a waterproof cable connector having a small volume which can be assembled quickly to prevent water permeating wires encased therein so improving safety and practicability.

The waterproof cable connector in accordance with the present invention has a body, two plugs and at least one sealing ring. The body has a chamber and two through holes communicating with the chamber. The plugs are respectively connected to the body and each plug has a clamping ring and a securing fastener. The clamping ring is mounted in the body and has multiple grooves and multiple tabs. The securing fastener is mounted around the clamping ring to press the tabs of the clamping ring with the wires. The at least one sealing ring is elastic and waterproof and is mounted between separate parts on the body to prevent water from permeating the chamber of the body.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
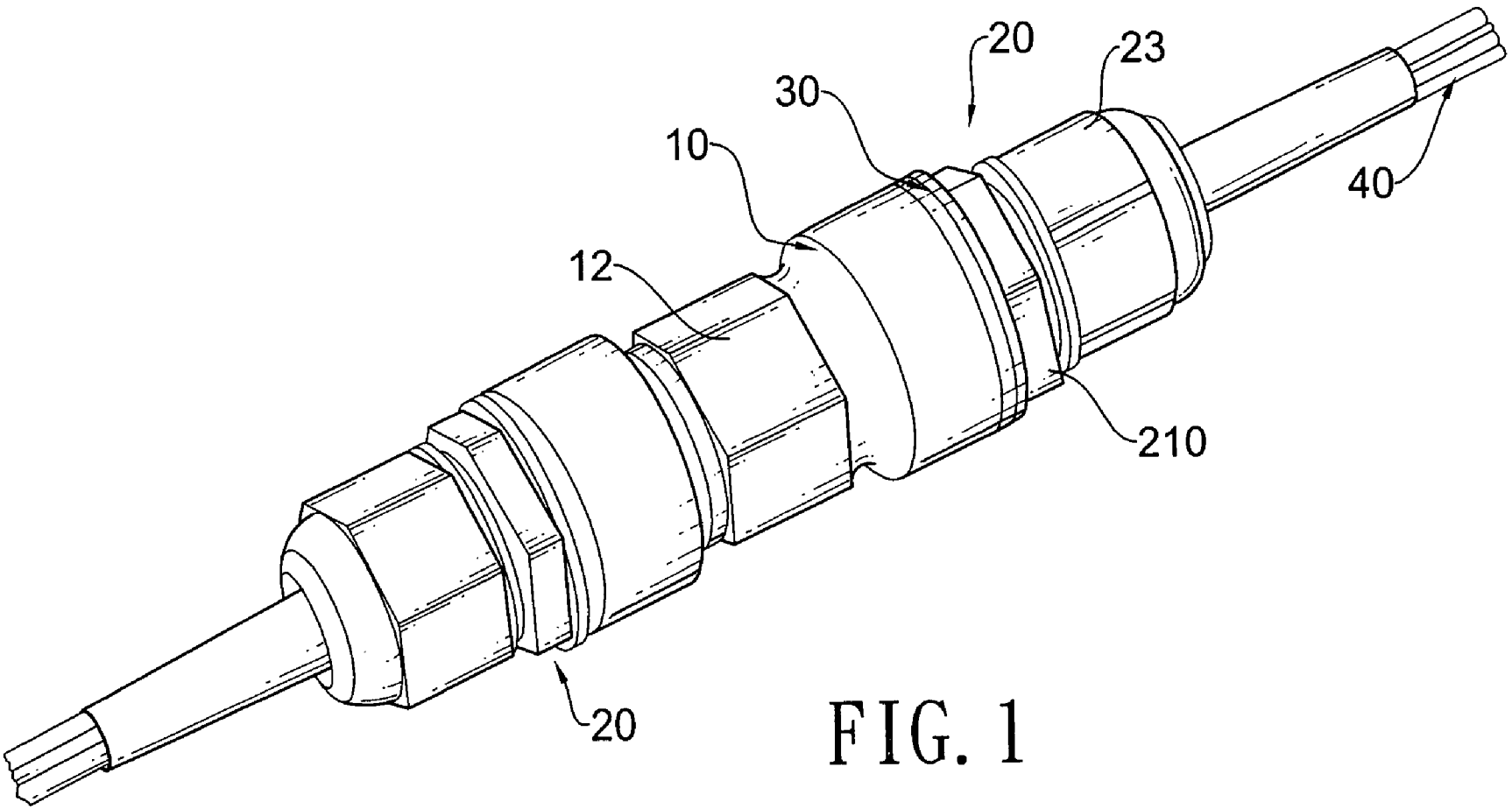
FIG. 1 is a perspective view of a waterproof cable connector in accordance with the present invention.
Figure 2:
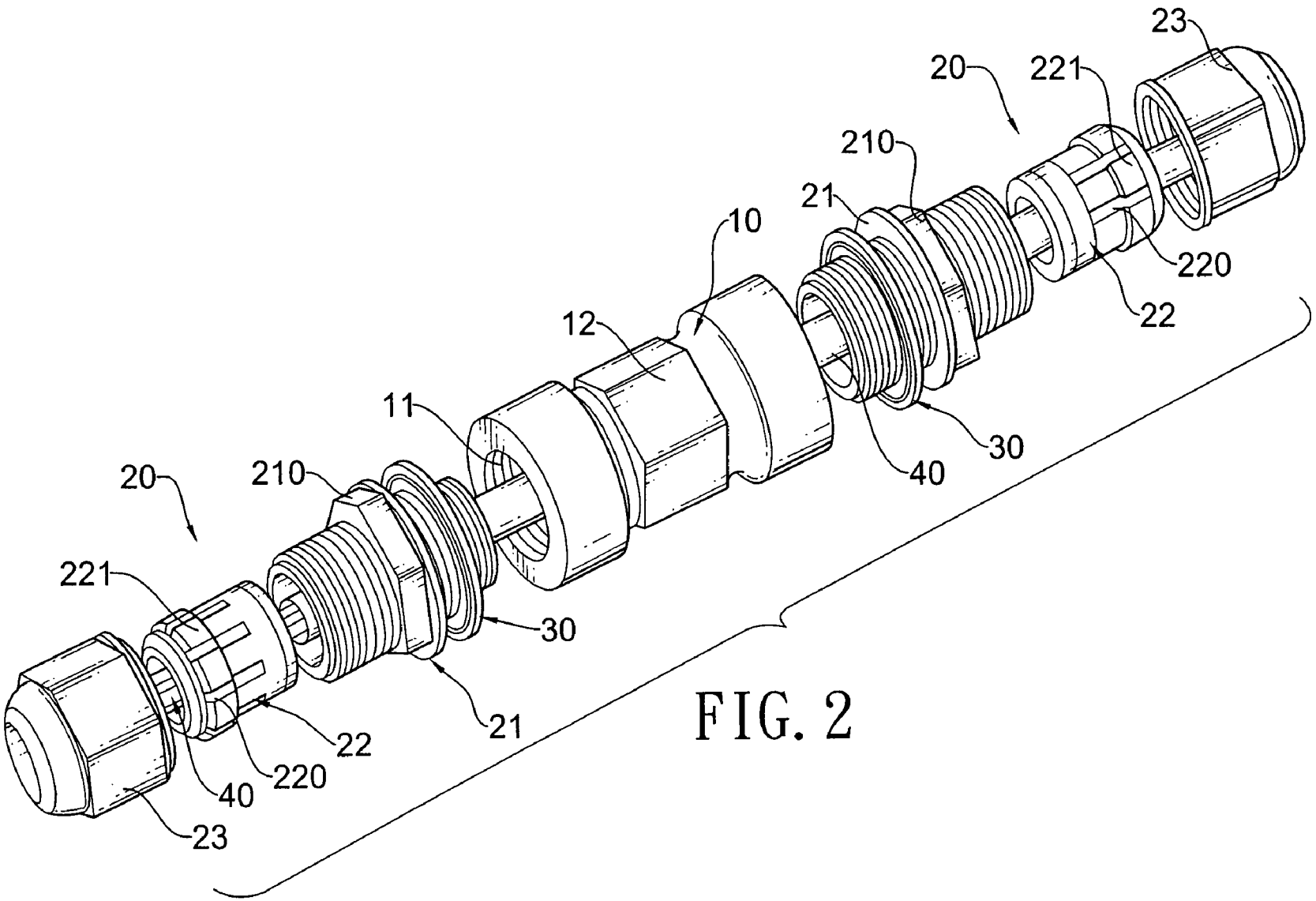
FIG. 2 is an exploded perspective view of the waterproof cable connector in FIG. 1.
Figure 3:
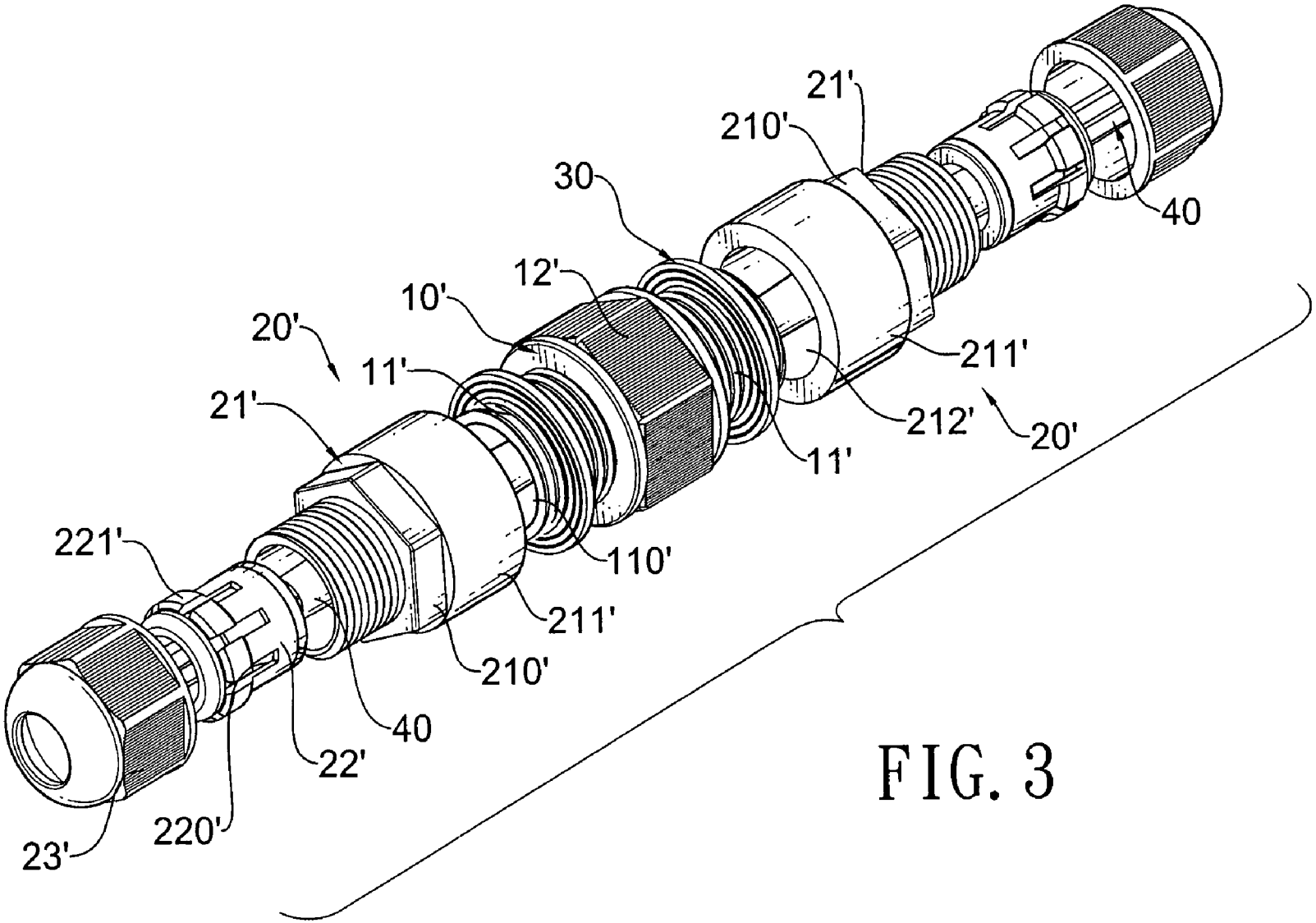
FIG. 3 is an exploded perspective view of a second embodiment of a waterproof cable connector in accordance with the present invention.
Figure 4:
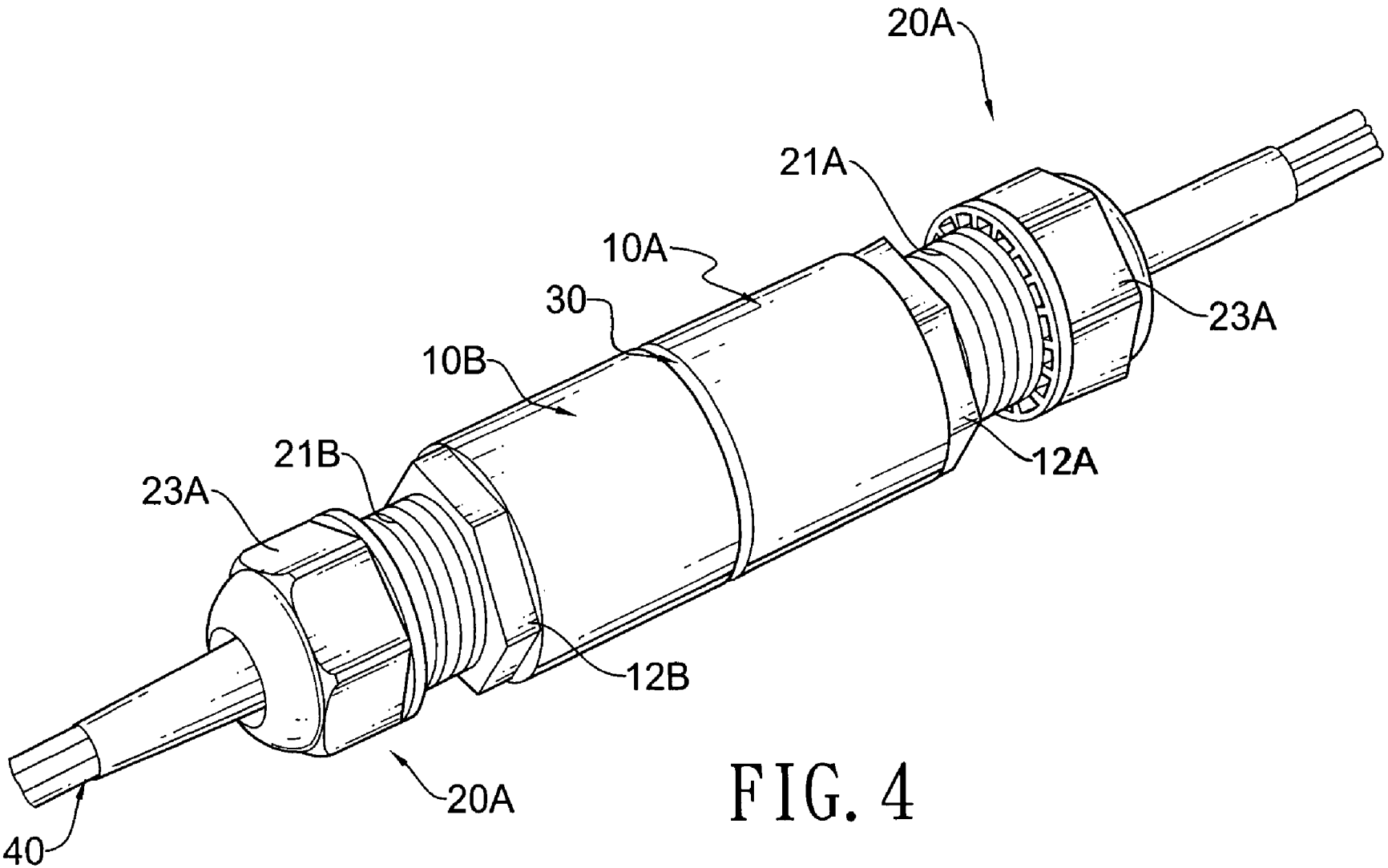
FIG. 4 is a perspective view of a third embodiment of a waterproof cable connector in accordance with the present invention.

With reference to FIGS. 1 to 5, a waterproof cable connector in accordance with the present invention connects two wires (40) and comprises a body (10, 10', 10A, 10B), two plugs (20, 20', 20A) and at least one sealing ring (30).

The wires (40) are connected to each other by a wire connector (41) or the like as well known in the art.

The body (10, 10', 10A, 10B) is a hollow tube, is mounted around the wires (40) and the wire connector (41) and the body (10, 10', 10A, 10B) has an optional circular cross-section, two outer ends, a chamber, an external surface, an internal surface, a middle, two through holes (11, 110') and a gripping surface (12, 12', 12A, 12B). The body (10, 10') may be integrally formed as a single element. The body (10A, 10B) may be formed from two detachably connected segments, maybe using a threaded protrusion (13A) formed on one connected segment and a recessed thread (13B) formed on the other and sealably engaging each other along an axial direction of the body (10A, 10B) and the body (10A, 10B) has two through holes (14A, 14B) respectively formed through the connected segments. The chamber is defined in the body (10, 10', 10A, 10B). The through holes (11, 110') are respectively formed through outer ends of the body (10, 10', 10A, 10B) and communicate with the chamber. The outer ends of the body (10, 10', 10A, 10B) each has a thread (11, 11'). The thread (11) at the outer ends of the body (10) may be formed on the internal surface of the body (10), or the thread (11') may be formed on the external surface of the body (10'). The gripping surface (12, 12', 12A, 12B) is formed around the external surface of the body (10, 10', 10A, 10B) maybe near the middle, is polygonal and may be a hexagonal shape and facilitates gripping and rotation of the body (10, 10', 10A, 10B), maybe by engaging a tool or hand. The tool may be pliers, monkey grips, a spanner or the like. Two gripping surface (12A, 12B) may be implemented respectively adjacent to the outer ends of the body (10A, 10B).

The plugs (20, 20', 20A) are respectively connected to the outer ends of the body (10, 10', 10A, 10B) via the through holes (11, 110', 14A, 14B) and each plug (20, 20', 20A) has a hollow threaded bolt (21, 21', 21A, 21B), a clamping ring (22, 22', 22A) and a securing fastener (23, 23', 23A).

The hollow threaded bolt (21, 21') is attached to a corresponding outer end of the body (10, 10'), may be double ended and has an external surface, an internal surface, an outer end, an inner end and a gripping surface (210, 210'). The outer end of the threaded bolt (21, 21', 21A, 21B) has an outer thread formed on the external surface of the threaded bolt (21, 21'). The inner end of the threaded bolt (21, 21', 21A, 21B) corresponds to and is attached to the corresponding outer end of the body (10, 10', 10A, 10B) and may be threaded. The inner end of the threaded bolt (21A, 21B) may be formed on the outer end of body (10A, 10B). The inner end of the threaded bolt (21) may be threaded on the external surface, or the inner end of the threaded bolt (21') may be threaded on the internal surface. The gripping surface (210, 210') of the threaded bolt (21, 21') is formed around the external surface of the threaded bolt (21, 21') between the inner and outer ends and may be polygonal to facilitate gripping and rotation of the threaded bolt (21, 21') maybe by engaging a tool or hand. When the threaded bolts (21A, 21B) are formed on the body (10A, 10B), the gripping surfaces of the threaded bolts (21A, 21B) are the gripping surfaces (12A, 12B) of the body (10A, 10B).

The clamping ring (22, 22', 22A) is mounted in the threaded bolt (21, 21', 11A, 11B) and has an external surface, an inner end, an outer end, multiple grooves (220, 220', 220A) and multiple tabs (221, 221', 221A). The inner end of the clamping ring (22, 22', 22A) is mounted in the outer end of the threaded bolt (21, 21'). The grooves (220, 220', 220A) are individually formed through the external surface of the clamping ring (22, 22', 22A) at intervals near the outer end. The tabs (221, 221', 221A) are formed on the outer end of the clamping ring (22, 22', 22A) between the grooves (220, 220', 220A).

The securing fastener (23, 23', 23A) is mounted around the outer end of the clamping ring (22, 22', 22A), engages the threaded outer end of the threaded bolt (21, 21', 21A, 21B), abuts and presses the tabs (221, 221', 221A) of the clamping ring (22, 22', 22A) against the wire (40) to hold the wire (40) securely in the waterproof cable connector.

Figure 5:
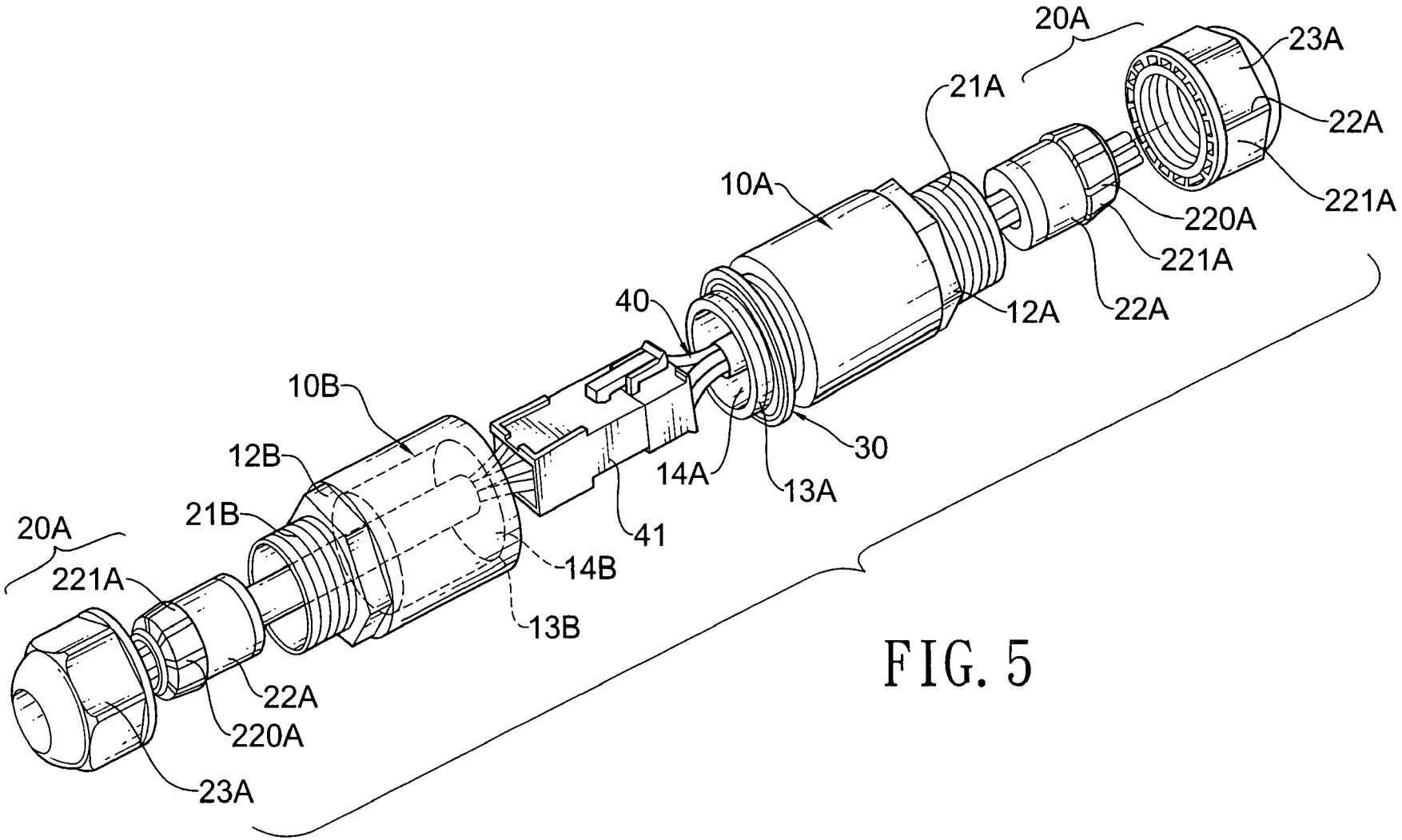
FIG. 5 is an exploded perspective view of the waterproof cable connector in FIG. 4.
Figure 6:
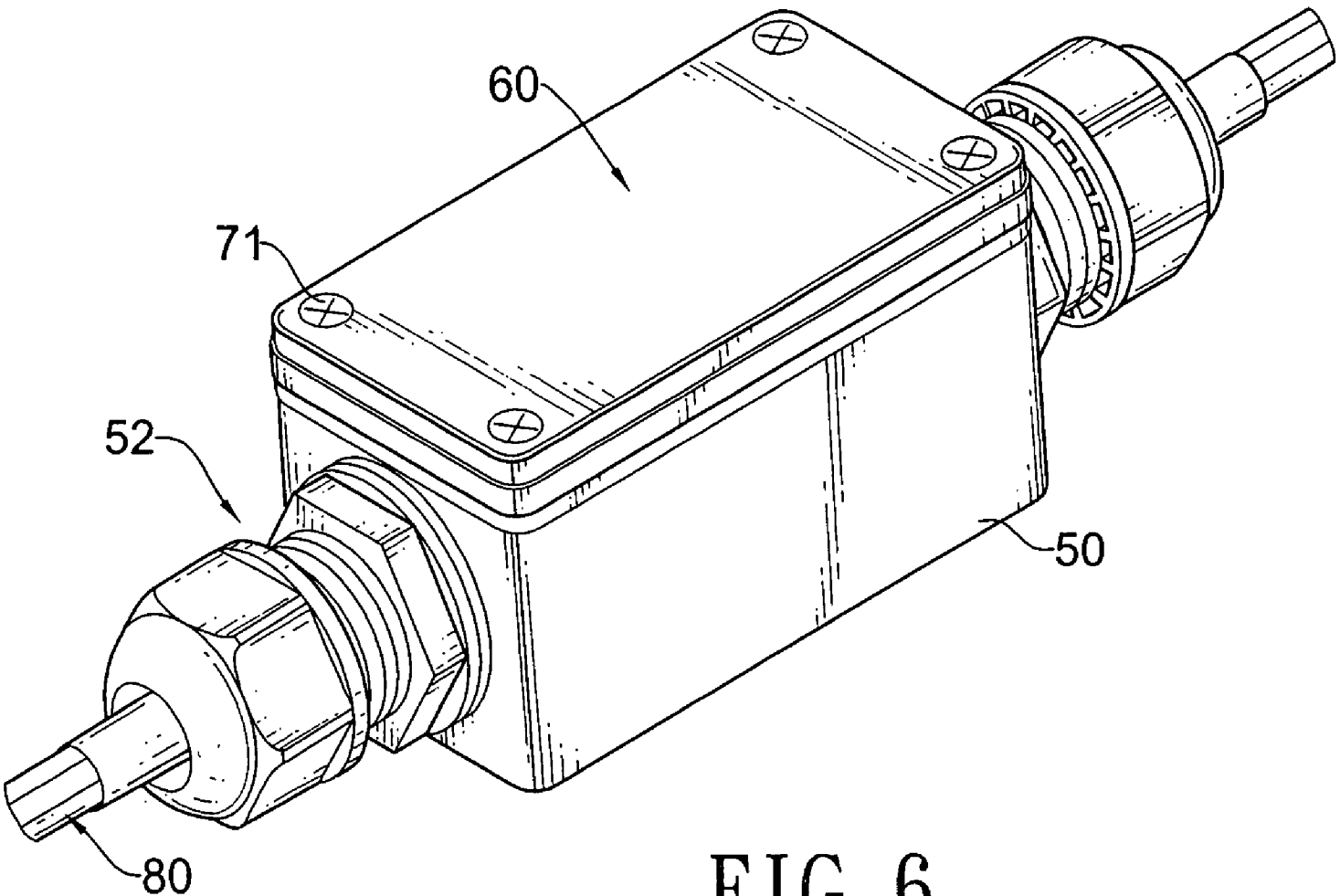
FIG. 6 PRIOR ART
FIG. 6 is a perspective view of a waterproof cable connector in accordance with the prior art.
Figure 7:
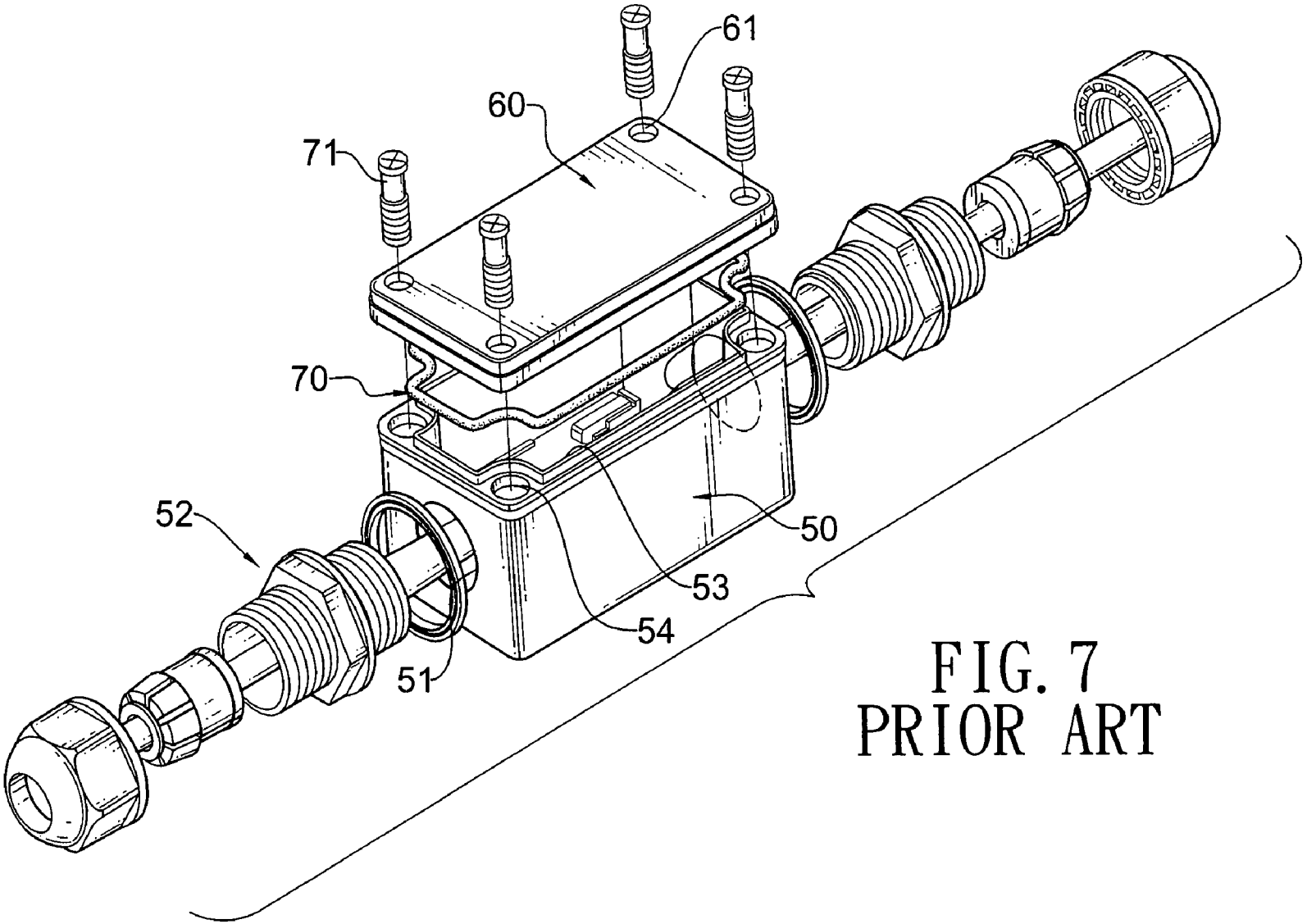
FIG. 7 PRIOR ART
FIG. 7 is an exploded perspective view of the waterproof cable connector in FIG. 6.

The at least one sealing ring (30) is elastic and waterproof and is mounted between connecting parts to prevent permeation of water therebetween. Two sealing rings (30) may be respectively mounted between the body (10, 10') and the plugs (20, 20'). One sealing washer (30) may be mounted in the body (10A, 10B) between the two connected segments of the body (10A, 10B) as shown in FIG. 5.

When assembling the waterproof cable connector, the plugs (20, 20', 20A) are easily fitted to the at least one body (10, 10', 10A, 10B) to provide a waterproof effect, and this is time-saving. Furthermore, the at least one body (10, 10', 10A, 10B) of the waterproof cable connector is smaller than a casing (50) of a conventional waterproof cable connector so is more convenient and cheaper to produce.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A waterproof cable connector comprising:

a body having two outer ends and each outer end having a thread;

a chamber being defined in the body;

an external surface;

a middle; and two through holes being respectively formed through the outer ends of the body and communicating with the chamber;

two plugs being respectively connected to the outer ends of the body and each plug having a hollow threaded bolt being attached to a corresponding outer end of the body and having an external surface;

an outer end having an outer thread formed on the external surface of the threaded bolt; and an inner end corresponding to and being attached to the corresponding outer end of the body;

a clamping ring being mounted in the threaded bolt and having an external surface;

an inner end being mounted in the outer end of the threaded bolt;

an outer end;

multiple grooves being individually formed through the external surface of the clamping ring at intervals near the outer end; and multiple tabs being formed on the outer end of the clamping ring between the grooves; and a securing fastener being mounted around the outer end of the clamping ring, engaging the outer end of the threaded bolt near the front end and abutting the tabs of the clamping ring; and two sealing rings being an elastic and waterproof material and being respectively mounted between the body and the plugs.

2. The waterproof cable connector of claim 1, wherein the body has an internal surface and a circular cross-section; and the threads are formed on the internal surface of the body.

3. The waterproof cable connector as claimed in claim 2, wherein the body further has a gripping surface being formed around the external surface of the body and being polygonal.

4. The waterproof cable connector as claimed in claim 3, wherein the gripping surface is formed near the middle.

5. The waterproof cable connector as claimed in claim 4, wherein each threaded bolt further has a gripping surface being formed around the external surface of the threaded bolt between the inner and outer ends of the threaded bolt and being polygonal.

6. The waterproof cable connector of claim 1, wherein the threads are formed on the external surface of the body.

7. The waterproof cable connector as claimed in claim 6, wherein the body further has a gripping surface being formed around the external surface of the body and being polygonal.

8. The waterproof cable connector as claimed in claim 7, wherein the gripping surface is formed near the middle.

9. The waterproof cable connector as claimed in claim 8, wherein each threaded bolt further has a gripping surface being formed around the external surface of the threaded bolt between the inner and outer ends of the threaded bolt and being polygonal.

10. The waterproof cable connector as claimed in claim 1, wherein the body further has a gripping surface being formed around the external surface of the body and being polygonal.

11. The waterproof cable connector as claimed in claim 1, wherein each threaded bolt further has a gripping surface being formed around the external surface of the threaded bolt and being polygonal.

12. The waterproof cable connector as claimed in claim 10, wherein the body further has two gripping surfaces being respectively formed around the external surface adjacent to the outer ends of the body and being polygonal.

13. A waterproof cable connector comprising:

a body being a hollow tube, being formed from two detachably connected segments and connected each other along an axial direction of the body by using a threaded protrusion formed on one connected segment and a recessed thread formed on the other connected segment sealably engaging each other and having two outer ends;

a chamber being defined in the body;

an external surface;

a middle; and two through holes being respectively formed through the outer ends of the body and communicating with the chamber;

two plug being respectively connected to the outer ends of the body and each plug having a hollow threaded bolt being formed on a corresponding outer end of the body and having an external surface;

an inner end being formed on the body; and an outer end having an outer thread formed on the external surface;

a clamping ring being mounted in the threaded bolt and having an external surface;

an inner end being mounted in the outer end of the threaded bolt;

an outer end;

multiple grooves being individually formed through the external surface of the clamping ring at intervals near the outer end; and multiple tabs being formed on the outer end of the clamping ring grooves; and a securing fastener being mounted around the outer end of the clamping ring engages the threaded outer end of the threaded bolt and abuts the tabs of the clamping ring; and a sealing ring being an elastic and waterproof material and mounted between the two segments of the body.

14. The waterproof cable connector of claim 13, wherein the body further has two gripping surfaces being respectively formed around the external surface adjacent to the outer ends of the body and being polygonal.

* * * * *